US005803007A

United States Patent [19]

Stevens

[11] Patent Number: 5,803,007

[45] Date of Patent: Sep. 8, 1998

[54] MODULAR PONTOON DECK

[76] Inventor: Ernest John Stevens, 6247 Sandy Pointe, Troy, Mich. 48098

[21] Appl. No.: 843,781

[22] Filed: Apr. 21, 1997

[51] Int. Cl.[6] ..... B63B 35/44

[52] U.S. Cl. ..... 114/266; 114/267; 114/352; 114/361; 114/363

[58] Field of Search ..... 114/77 R, 352, 114/363, 364, 266, 267, 357, 361

[56] References Cited

U.S. PATENT DOCUMENTS

| | | | |
|---|---|---|---|
| 146,316 | 1/1874 | Clark . | |
| 1,900,319 | 3/1933 | Vermeulen . | |
| 2,413,226 | 12/1946 | Hallward . | |
| 2,722,699 | 11/1955 | Boonstra . | |
| 3,057,315 | 10/1962 | Robishaw . | |
| 3,152,568 | 10/1964 | Mayer . | |
| 3,166,037 | 1/1965 | Otis . | |
| 3,179,076 | 4/1965 | Sheffield . | |
| 3,191,565 | 6/1965 | Filak . | |
| 3,221,696 | 12/1965 | Gardner . | |
| 3,522,618 | 8/1970 | Stranzinger . | |
| 3,691,974 | 9/1972 | Seiford, Sr. et al. | 114/266 |
| 3,763,808 | 10/1973 | Smith, Sr. . | |
| 4,683,901 | 8/1987 | Mitchell | 114/361 |
| 4,928,617 | 5/1990 | Meriwether . | |
| 4,988,317 | 1/1991 | Rubinsak et al. . | |
| 5,020,175 | 6/1991 | Kirkpatrick et al. . | |
| 5,094,607 | 3/1992 | Masters | 114/357 |
| 5,183,001 | 2/1993 | Stranzinger | 114/266 |
| 5,199,370 | 4/1993 | Berquist | 114/267 |
| 5,238,231 | 8/1993 | Huang . | |
| 5,355,825 | 10/1994 | Lefebvre et al. | 114/267 |

*Primary Examiner*—Sherman Basinger
*Attorney, Agent, or Firm*—Dykema Gossett PLLC

[57] ABSTRACT

A modular float for forming a floating structure includes a top surface, a bottom surface and a plurality of sides connecting the top surface and the bottom surface. Each of the sides has a plurality of engagement structures extending therefrom. The engagement structures are spaced apart from each other by a plurality of receivers. The engagement structures and the side define the receiver. Each of the sides have a channel extending between the top surface and the bottom surface. The channel is sized to receive a joining device.

30 Claims, 12 Drawing Sheets

MODULAR PONTOON DECK

BACKGROUND OF THE INVENTION

The present invention relates to a modular float or to a floating structure capable of use for many different functions. More specifically, the present invention relates to a floating device having a number of modular units that may be interlinked to form a modular pontoon deck or other floating structure.

It is common to interlink a number of relatively small floating structures or floats to form one of greater size. Interlinking a number of floating structures may be used for such things as swim platforms, docks, rafts and boats.

One problem associated with linking a number of floats together is that the connection between the floats has a tendency to have an abrupt and unstable interface between the two floats forming a floating structure. The unstable interface does not allow sure-footed mobility on such a structure. It would be desirable to eliminate the offset between the floats to make walking around the floating structure easier.

Many modular floating structures require a number of tools and a significant amount of time in order to assemble and disassemble such a structure. Another disadvantage of many structures is that the components used to connect such structures do not float. Thus, when assembling such structures, if a fastener is dropped into the water, the fastener may be irretrievably lost in the depth of the water.

Another problem with known floating structures is that accessories such as railings and seats that are commonly used on such a structure are not easily fastened to the structure. Many structures rely on the autonomy of the underlying float structure for buoyancy. By piercing the float structure to fasten accessories thereto, the float structure is weakened. Even if initially sealed, the float may eventually leak. It would therefore be desirable to provide a convenient system for mounting in which to mount desired accessories to a floating structure without compromising or weakening the structure.

SUMMARY OF THE INVENTION

It is therefore an object of the invention to provide an improved modular pontoon deck or floating structure which is economical to manufacture, simple in construction and efficient and safe to use.

According to one aspect of the invention, a modular float is disclosed which includes a top surface, a bottom surface and a plurality of sides connecting the top surface and the bottom surface. Each of the sides has a plurality of engagement structures extending therefrom. The engagement structures are spaced apart from each other by a plurality of receivers. The engagement structures and the side define the receivers. Each of the sides has a channel extending between the top surface and the bottom surface. The channel is sized to receive a joining device.

In one aspect of the invention, a number of modular floats are coupled together by matingly engaging engagement structures and receivers on one modular float with engagement structures and receivers of an adjacent modular float. Once matingly engaged, the floats have a tendency to stay together. A joining device is placed in the channel between the adjacent sides to help maintain the top surfaces at a substantially even plane. The joining device is preferably hollow so that it will float.

In another aspect of the invention, attachment devices that are sized to be received within receivers may be used to couple pontoons to the perimeter of the floating structure. The attachment devices may also be used to secure seats above the top surface of the float. A seat may extend between the attachment devices. The attachment device may also be used to secure a rail or railing or to support a canopy. Once the pontoons are assembled to the perimeter, a motor mount may be secured to a pontoon. A trolling motor may be coupled to the motor mount and used to propel the floating structure.

In still another aspect of the invention, the method of making a modular float comprises the steps of taking a mold having an internal cavity corresponding to the outer configuration of a modular float, placing a powdered or granular plastic material in the mold when opened, subjecting the mold to heat to melt the plastic while rotating the mold to fill the cavity with the melted plastic material, and cooling the mold to solidify the plastic and thereby form the modular float unit having engagement structures formed therein that define receivers therebetween.

One advantage of the present invention is that the joining devices help keep the top surfaces of adjacent modular floats in nearly a planar configuration.

Another advantage of the present invention is that the floating structure using the modular floats may be easily assembled and disassembled. A small disassembled floating structure may easily fit into the back of a pickup truck for easy transportation.

Another advantage of the present invention is that each of the structures, including the accessories, may be formed of a hollow plastic so that they will float. By providing floating components, the components will not be easily lost if dropped into the water.

BRIEF DESCRIPTION OF THE DRAWINGS

Other features and advantages of the present invention will become apparent from the following detailed description which should be read in conjunction with the drawings in which.

DETAILED DESCRIPTION OF THE PREFERRED EMBODIMENT

Figure 1:
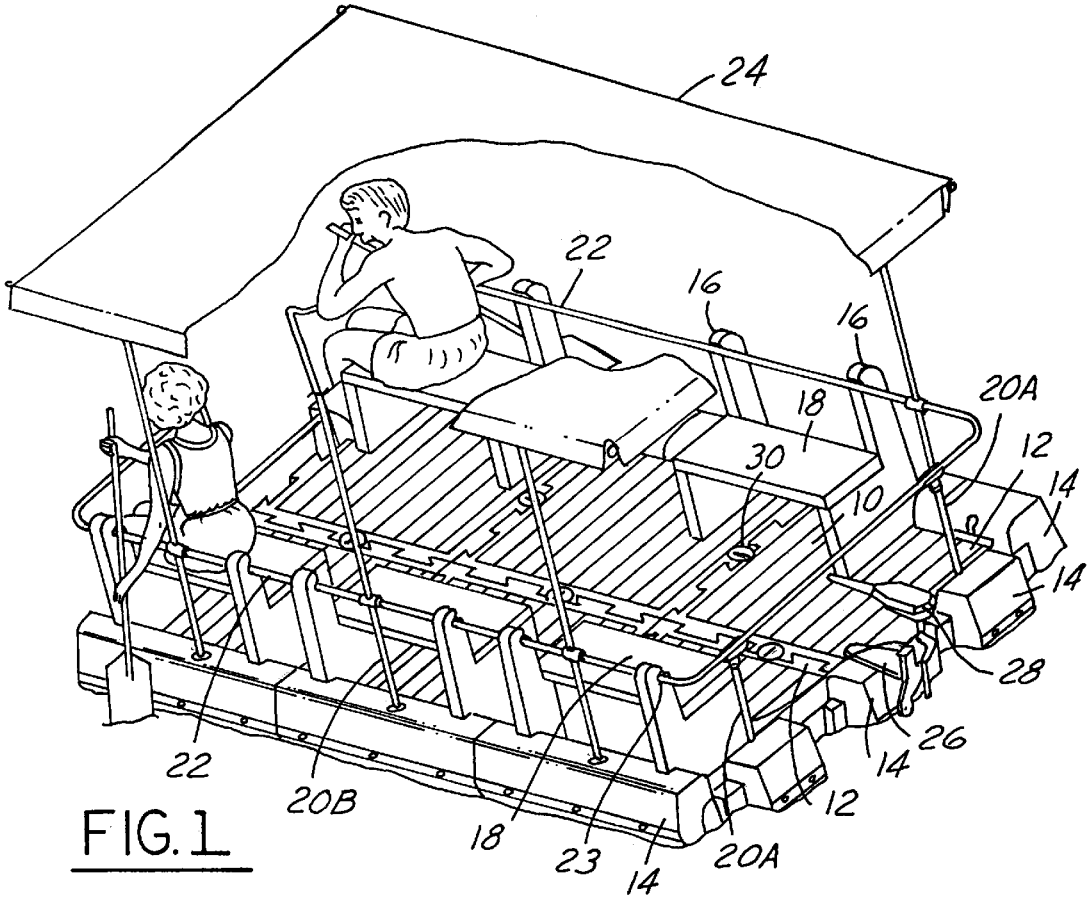
FIG. 1 is a perspective view of a raft in water containing modular floats according to the present invention.

Referring now to the drawings, like referenced numerals are used to identify identical components in the various views. Although the invention will be illustrated in the context of one configuration for a modular float, it will be appreciated that this invention may be adapted for other uses using different geometry and proportions while still being within the scope of the invention.

Referring now to FIG. 1, a floating structure may be used for a variety of purposes, such as, rafts, docks and boats. Each of the floating structures, according to the present invention, generally has a floating platform 10 formed of a number of floats 12 that are linked together. Floats 12 are preferably a singular hollow structure and may be formed of a plastic material such as high density polyethylene. As shown, platform 10 is formed of six floats 12. It is preferred that floats 12 are modular and are interlocked.

Each float 12 may have a deck or decking 13 on its surface. Decking 13 is preferably made of a non-slip material. Decking 13 may also be recessed into the surface of float 12 to form a smooth surface across float 12.

Platform 10 has a number of pontoons 14 connected to its perimeter. Pontoons 14 may be used to increase the buoyancy of the edges of floats 12.

Platform 10 may support a number of seat supports 16 that support seats or seating surfaces 18. Platform 10 may also have a plurality of vertical railing supports 20 A and 20 B coupled thereto. Railing supports 20A support a plurality of rails or railings 22. Railings 22 may also be coupled to seat supports 16 at rail guides 23. Railing supports 20B may also be used to support a canopy 24. Canopy 24 may extend over part of or the entire platform 10.

Pontoons 14 may be used to support a motor mount 26. Motor mount 26 may be a metal bracket secured to pontoon 14 for securing a motor 28 thereto. Motor 28 is preferably an electric outboard trolling motor.

Floats 12 are preferably coupled together with a joining device 30. It is preferred that each adjacent float has at least one joining device therebetween.

Figure 2:
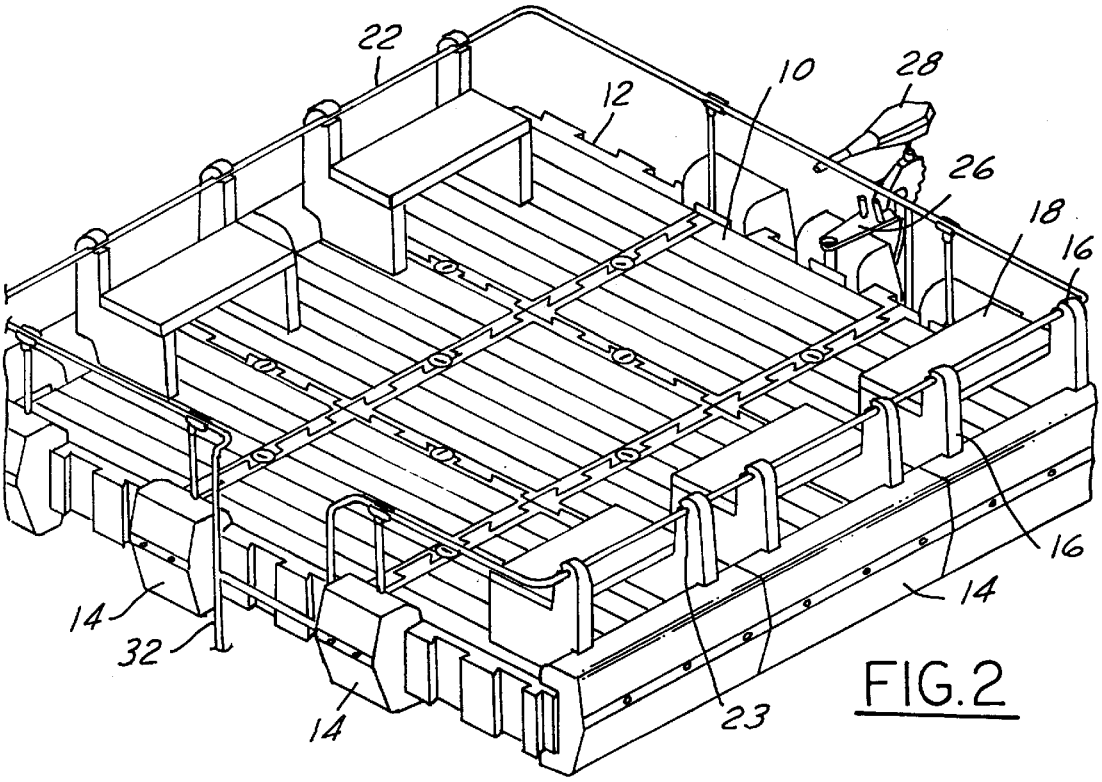
FIG. 2 is a perspective view of an alternate configuration of a raft out of water using modular floats.

Referring now to FIG. 2, platform 10 is shown formed of nine modular floats 12. Railing 22 extends around the perimeter of platform 10 except for an opening used to support a swim ladder 32. Swim ladder 32 may be formed of the same material as railing 22, such as plastic, for example.

Figure 3:
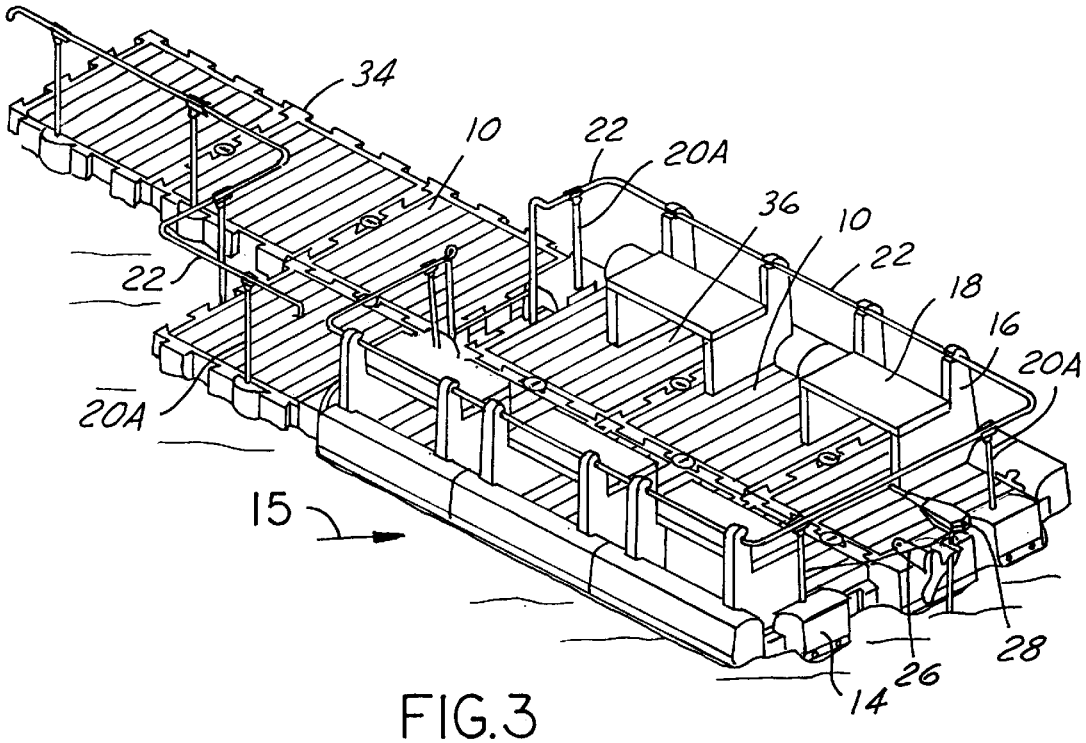
FIG. 3 is a perspective view of modular floats being used as a dock and raft.

Referring now to FIG. 3, two platforms 10 are shown. One platform is used as a dock 34. The other platform is used as a boat 36. Dock 34 is formed of four floats 12. Dock 34 also has a railing 22 coupled thereto with railing supports 20A. If desired, a canopy or swim ladder may be attached to dock 34.

Boat 36 is similar to that shown in FIG. 2 except that boat 36 is formed using six modular floats 12.

Figure 4:
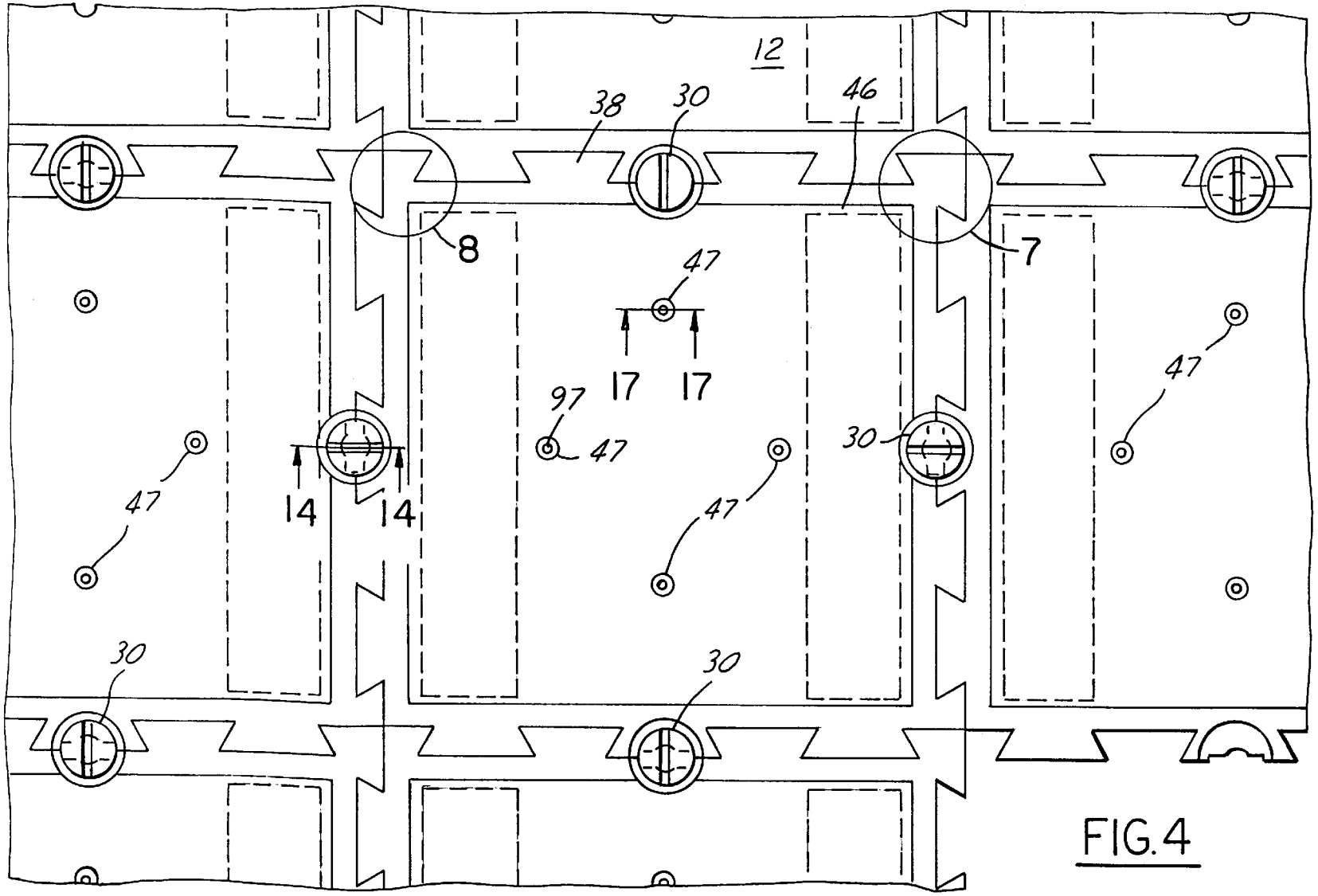
FIG. 4 is a partial top view of a floating structure using modular floats.

Referring now to FIG. 4, a top view of a number of floats 12 is shown without decking. Each of the floats 12 has a plurality of engagement structures 38 and receivers 40 spaced around the perimeter. The engagement structures 38 extend from the side of float 12 are preferably integrally formed into float 12. Between each engagement structure 38 is a receiver 40,that is sized to receive an engagement structure 38 of an adjacent float 12. Each engagement structure 38 has angled sides extending from float 12. Angled sides 42 extend from float 12 so that the engagement structure 38 gets wider as it extends from the side of float 12. The shape of engagement structure is generally referred to as a "dove-tail" shape. Receiver 40 has an opposite shape than engagement structure 38. That is, receiver 40 gets narrower as it extends from the float 12. Adjacent floats 12 may be engaged by sliding engagement structure 38 of one float into the receiver 40 of another float.

Once engaged, engagement structure 38 and receiver 40 may still allow relative displacement between the top surfaces of adjacent floats. To prevent relative movement, a channel 44 extends between the top surface and bottom surface of float 12. One-half of channel 44 is formed in each float 12. It is preferred that one-half of one channel 44 of one float 12 aligns with the other half of channel 44 on an adjacent float 12. Channel 44, for example, may be placed in the center of a side of float 12. Joining device 30 is placed within channel 44 to secure adjacent floats. Preferably one joining device 30 is used between sides of adjacent floats 12. Several joining devices 30, however, could be used.

Floats 12 may have a pair of ridges 46 extending across the bottom of float 12. Ridges 46 increase the stability of float 12 particularly when used as a boat.

Engagement structure 38 and receiver 40 may be placed along the sides of float 12 so that the adjacent floats will only align in a particular direction. That is, for example, so ridges 46 are all aligned in a parallel direction. As can be seen, each comer of a float 12 is different.

Platform 10 has a series of stiffening recesses 47 or kiss-offs that may be recessed into the surface of float 12. Stiffening recesses 47 may be used to secure attachments to float 12 utilizing hole 97 as will be further described below.

Figure 5:
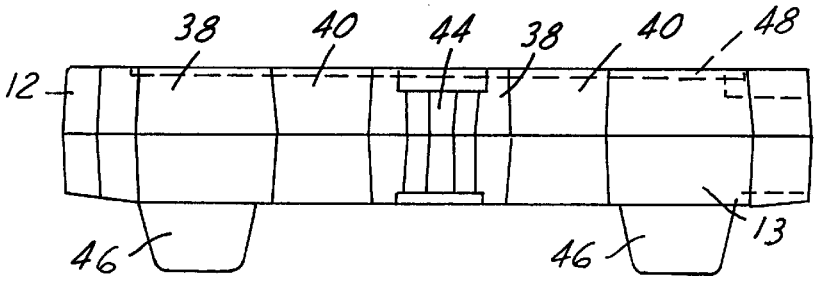
FIG. 5 is a side elevation of a modular float.
Figure 6:
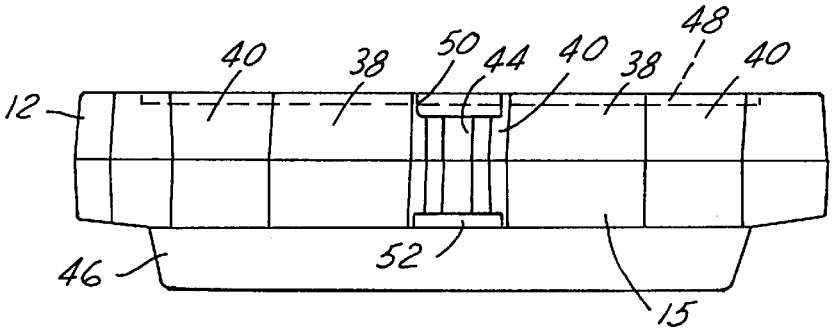
FIG. 6 is a side elevation of another side of a modular float from that of FIG. 5.

Referring now to FIGS. 5 and 6, a side view of a side 15 of a float 12 is shown. A recess 48 is formed in the top of float 12 to receive decking 13.

Channel 44 is shown extending between the top surface and bottom surface along an edge of float 12. Channel 44 has a top opening 50 and a bottom opening 52 wider than the rest of the channel 44.

Figure 7:
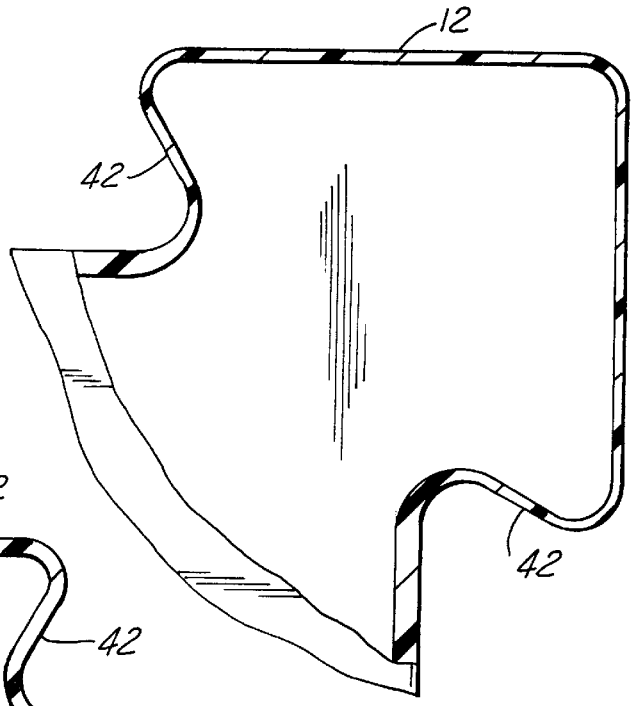
FIG. 7 is a partial cross-sectional view of one corner of a modular float.
Figure 8:
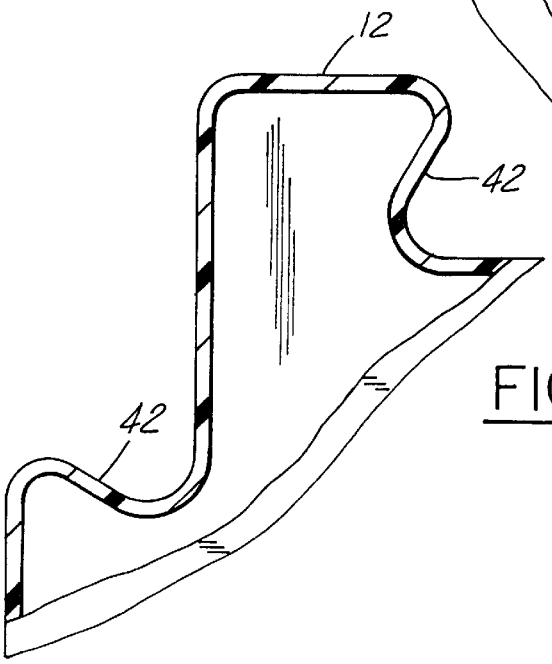
FIG. 8 is a partial cross-sectional view of another corner of a modular float.

Referring now to FIGS. 7 and 8, a cross-sectional view of two different corners of float 12 is shown. Angled sides 42 form the engagement structure 38 and receiver 40. On the comers of each float 12, as can best be seen in FIG. 4, only a portion of the engagement structure 38 and receiver 40 are formed at the corner. The rest of either engagement structure 38 or receiver 40 is formed by adjacent corners of adjacent floats 12. So in this manner, the alternating engagement structure 38 and receiver 40 extend along the entire side of a platform.

Figure 9:
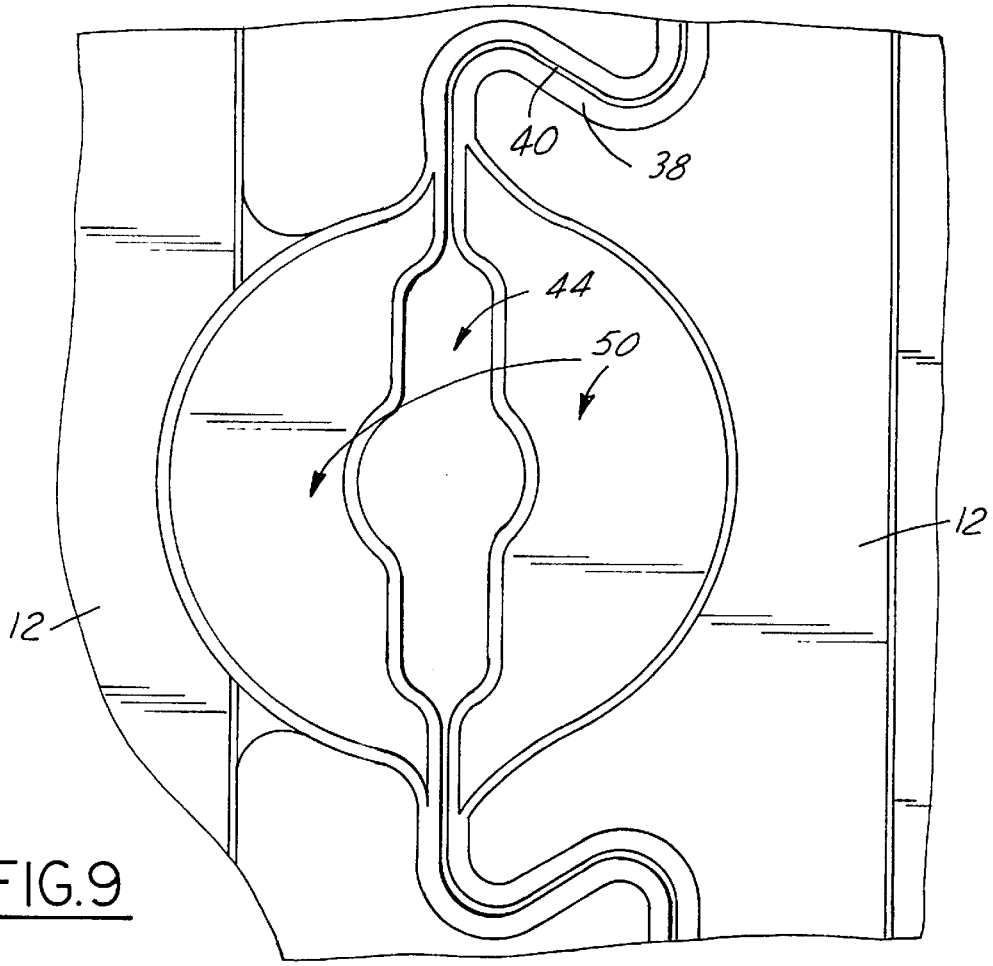
FIG. 9 is a top view of a channel between the top surface and bottom surface of a pair of engaged modular floats.

Referring now to FIG. 9, a top view of a channel 44 is shown between a receiver 40 and an engagement structure 38. Also shown is top opening 50, which is recessed into the tops of two adjacent floats 12. Channel 44 has generally an elongated shape that is sized to receive a portion of joining device 30.

Figure 10:
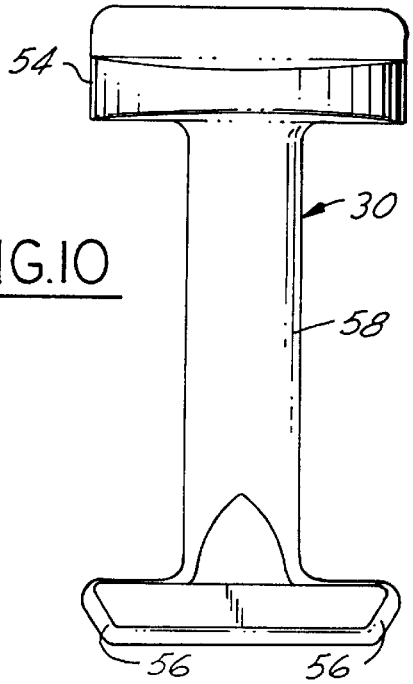
FIG. 10 is a side view of a joining device.
Figure 11:
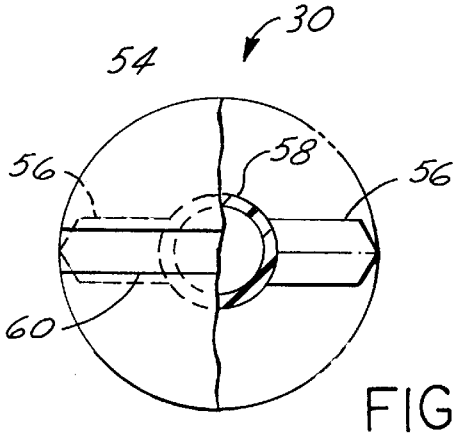
FIG. 11 is a partial cross-sectional view of a joining device.

Referring now to FIGS. 10 and 11, joining device 30 has a cap 54, arms 56 and a shank 58. Cap 54 is sized larger than channel 44 to engage adjacent floats. Arms 56 are sized to be received within channel 44 to link two adjacent floats together. Arms 56 are positioned on the other side of float 12 from cap 54. Adjacent floats 12 are held flush between cap 54 and arms 56.

Figure 12:
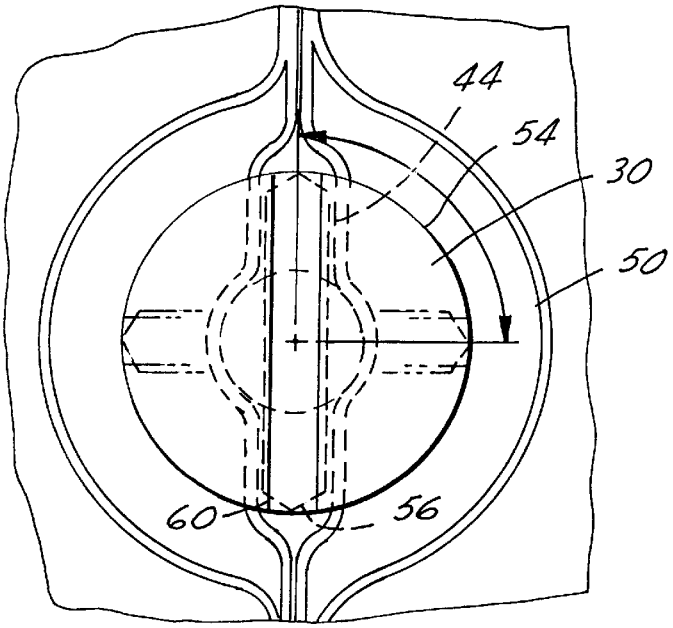
FIG. 12 is a partial top view of two modules being joined by a joining device.

Referring now to FIG. 12,joining device 30 is shown inserted into the top opening 50 and through channel 44. Joining device 30 is placed so that arms 56 extend through channel 44. Handle 60 preferably is aligned with the elongated direction of arms 56 so that a visual indication is given whether arms are engaged with the bottom of float. When inserted into channel 44, joining device 30 is rotated 90° so that arms 56 are perpendicular to the longitudinal axis of the opening in the top of elongated channel 44. Joining device 30 is a twist lock type device. That is, when arms are perpendicular to channel 44, adjacent floats 12 and joining device 30 are locked together.

Figure 13:
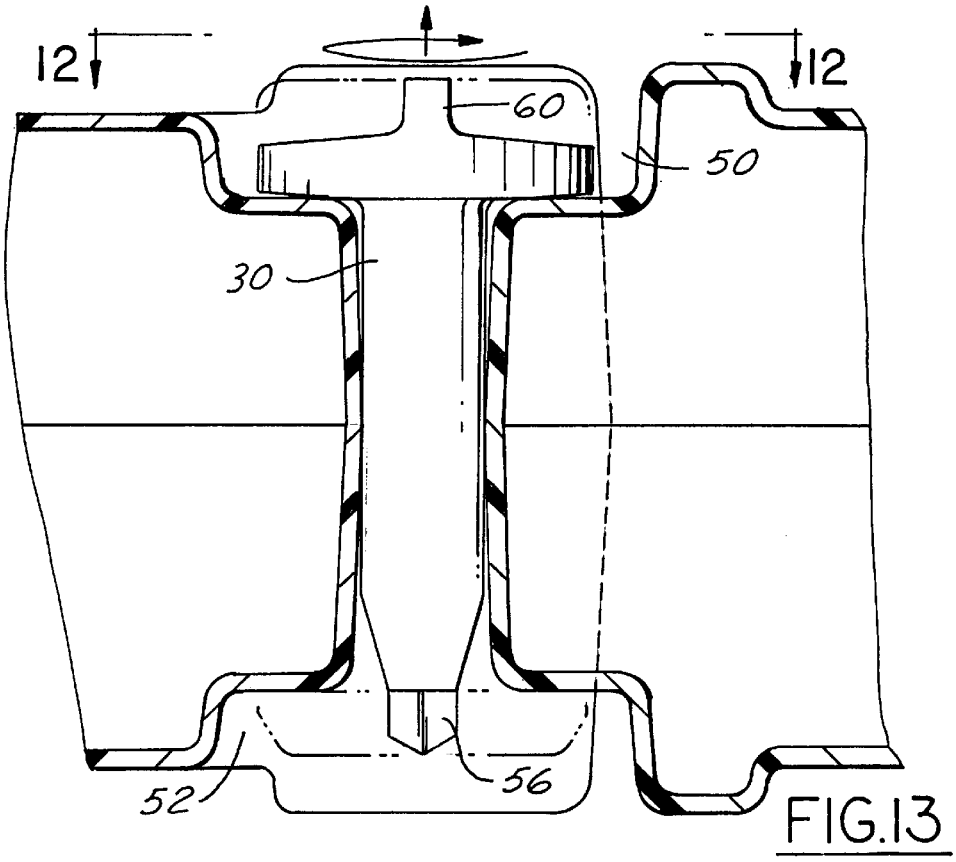
FIG. 13 is a partial cross-sectional view of a joining device illustrating a connection with two modular floats using a joining device.

Referring now to FIG. 13, the end view of arms 56 of joining device 30 is shown just after insertion. Arms 56 are not engaged with bottom opening 52.

Figure 14:
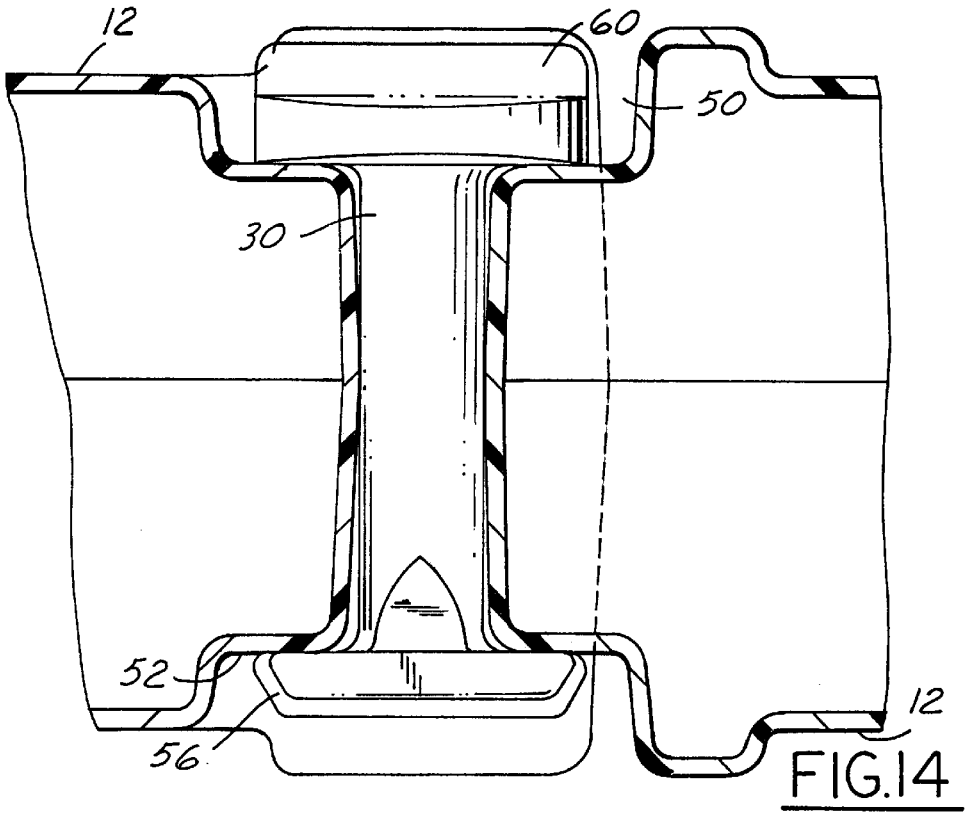
FIG. 14 is a partial cross-sectional view of a joining device joining adjacent modular floats.

Referring now to FIG. 14, arms 56 are shown engaged with bottom opening 52 to prevent movement between the adjacent floats 12. Handle 60 is sized so that the rotation of joining device 30 may be done without any tools. Joining device 30 may also be easily removed from channel 44 without tools.

It is preferred that joining device be formed of a hollow configuration so that upon dropping a joining device into the water, the joining device would not sink to the bottom.

Figure 15:
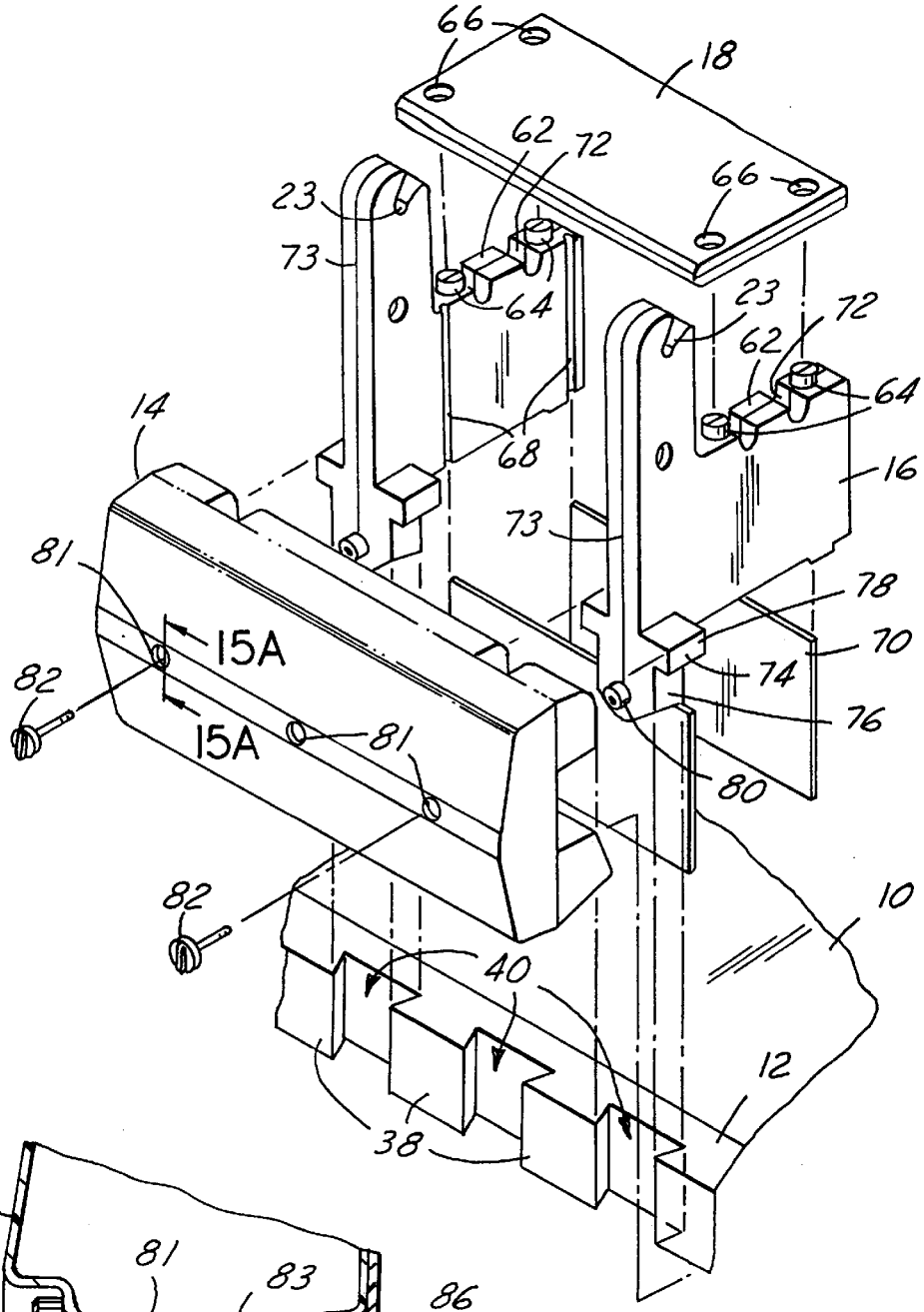
FIG. 15 is an exploded view of a seat attachment device and a pontoon with respect to a modular float.

Referring now to FIG. 15, seat support 16 is used to couple a seating surface 18 to float 12. Seat support 16 has a generally horizontal surface 62 and preferably has pegs 64 that couple with holes 66 through seat surface 18. It is preferred that seat surface 18 is easily removed and assembled with horizontal surface 62. Seat support 16 and seating surface 18 are also preferably formed of a hollow or floating material.

Seat support 16 may have vertical grooves 68 formed therein. Vertical grooves 68 may engage vertical panels 70. Vertical panels 70 and seat support 16 define a storage compartment under seating surface 18. Such a storage compartment may be used for holding such things as a battery for electric motor 28.

Horizontal surface 62 of seat support 16 may have channels 72 formed therein. Channels 72 may be used to assist in placing a finger beneath a seating surface 18 to help in gripping seating surface 18 for removal from seat support 16. Channels 72 may also be used to store a paddle (such as that shown in FIG. 1). Paddles may be used to position the platform in a desired location.

Seat support 16 may have a vertical extension 73 that extends from horizontal surface 62. Vertical extension 73 may be used to support a railing (such as that shown in FIGS. 1 and 3) in rail guides 23. Rail guides 23 may be integrally formed in vertical extension 73.

Seat support 16 may have an integrally formed coupler 74 that is used to connect the seat support 16 to floats 12. Coupler 74 has a receiving end 76 and a flange 78. Receiving end 76 is sized to fit within receiver 40. Receiving end 76 has a receiving hole 80 formed therein. Receiving hole 80 is used to receive a fastener 82 which first extends though pontoon recess 81 and pontoon hole 83. Fastener 82 holds pontoon 14 to seat support 16.

Figure 15A:
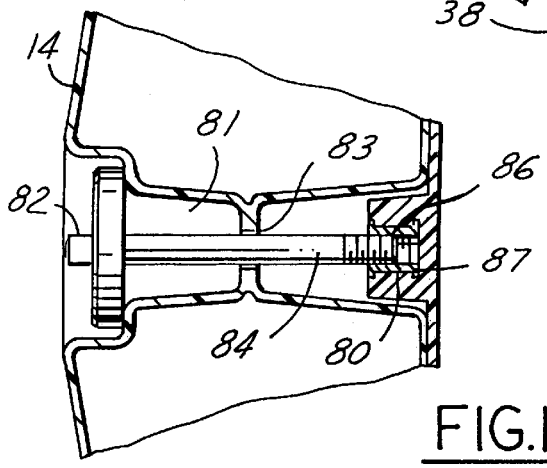
FIG. 15A is a cross-sectional view of a pontoon coupled to an attachment device.

Referring now to FIG. 15A, a cross-sectional view of a pontoon 14 is shown through receiving hole 80 and pontoon recess 81 and pontoon hole 83. Fastener 82 has a shaft 84 with threads 86 thereon. Threads 86 engage a blind insert 87 of receiving hole 80 to hold pontoon 14 with respect to seat support 16 and coupler 74.

Figure 16:
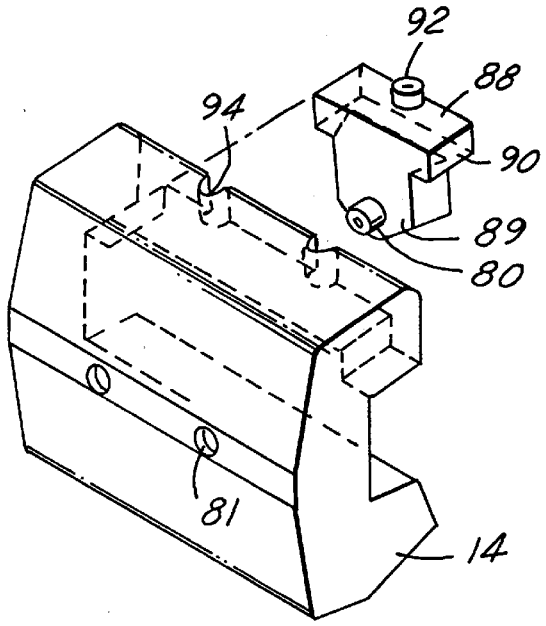
FIG. 16 is an exploded view of a pontoon with respect to an engagement device.

Referring now to FIG. 16, a pontoon 14 may also be coupled to platform 10 by a pontoon attachment 88 rather than a coupler 74. Pontoon attachment 88 is sized similar to coupler 74 of FIG. 15. Pontoon attachment 88 has receiving end 89 and a flange 90. Receiving end 89 is sized to fit within a receiver 40 on the edge of float 12. Pontoon attachment 88 may also have a receiving hole 92 with blind insert 87 for accepting railing support 20A. Pontoon 14 as shown is slightly smaller than the pontoon of FIG. 15. Various lengths of pontoons may be formed. Pontoon 14 may have notches 94 formed therein so that when a railing support 20A or 20B is connected to receiving hole 92, pontoon 14 will not interfere. Holes 83 of recess 81 in pontoon 14 may be used to receive a fastener in a similar manner as that of FIG. 15 to couple pontoon 14 to pontoon attachment 88. A flange 90 prevents pontoon attachment 88 from falling through receiver 40. Flange 90 is preferably formed integral with pontoon attachment 88.

Figure 17:
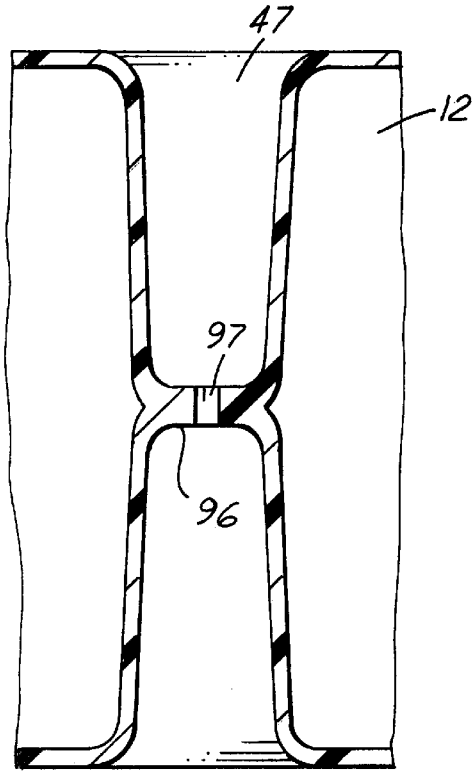
FIG. 17 is a partial cross-sectional view of a modular float in the area of a recess in the top and bottom surfaces of the modular float.

Referring now to FIG. 17, a cross-sectional view of recess 47 is shown. Recess 47 has a flange 96 extending thereacross with an opening 97 therethrough. Opening 97 is sized to receive a fastener (not shown) for additional attachments to top surface of float and for draining recess 48.

Figure 18:
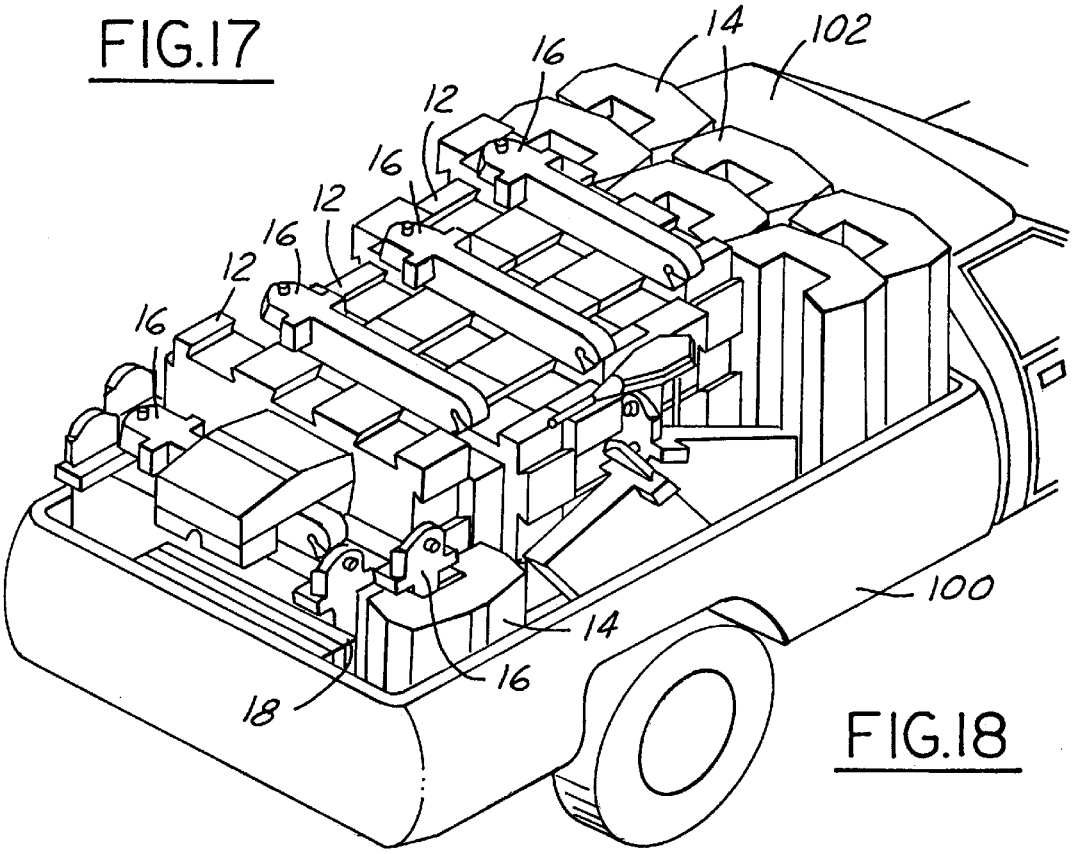
FIG. 18 is a perspective view of a pickup truck having a disassembled float assembly contained therein.

Referring now to FIG. 18, a bed 100 of a pick-up truck 102 is illustrated having a full platform disassembled and stored therein. In this manner, the platform 10 may be easily transported to the desired location and easily re-assembled. As shown, various seat supports 16, pontoons 14, floats 12 and seating surfaces 18 may be recognized.

Figure 20:
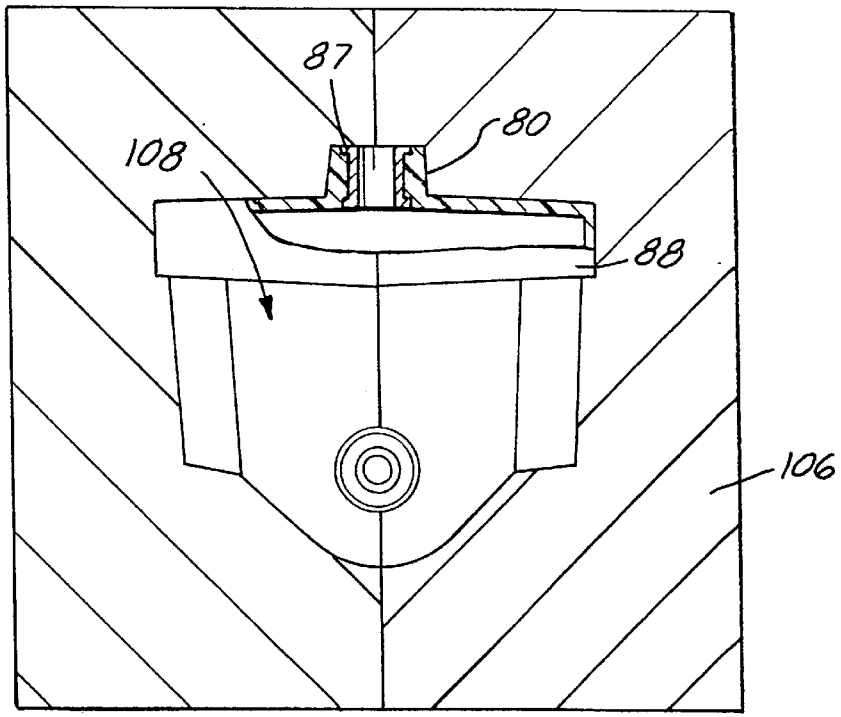
FIG. 20 is a cross-sectional view of a mold for making an attachment device.
Figure 19:
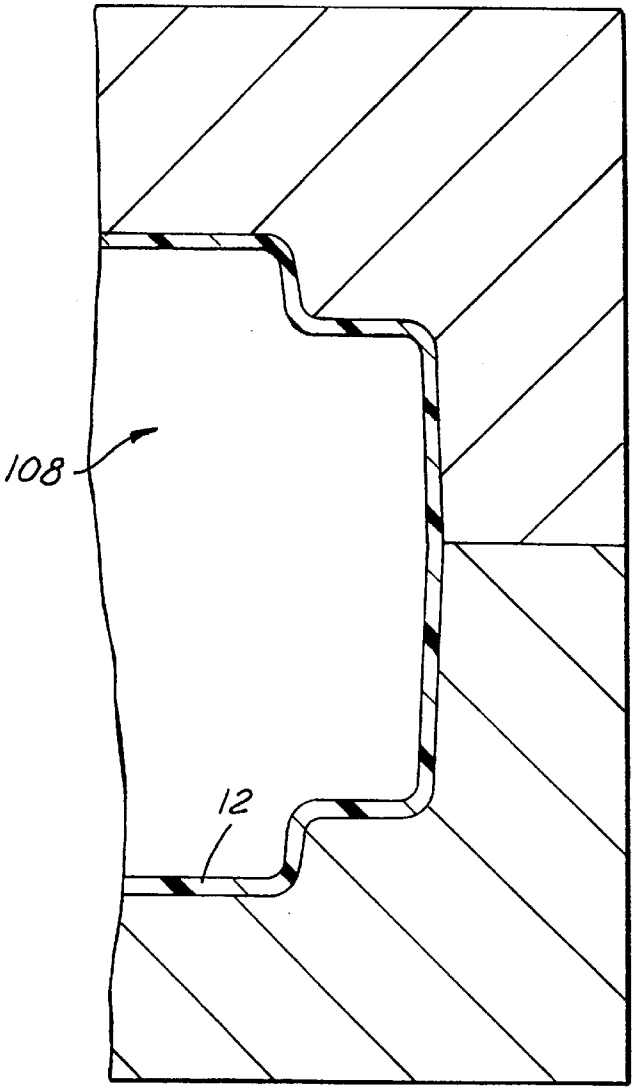
FIG. 19 is a partial cross-sectional view of a mold for making a modular float.

Referring now to FIG. 19, a mold 104 is used to form a float 12. It is preferred that float 12 is an airtight vessel so that leakage does not occur. Referring also to FIG. 20, a mold 106 for forming a pontoon attachment 88 is shown. It is also preferred that pontoon attachment 88 is a hollow airtight member. Any of the parts of platform may be formed in a similar manner. One method for forming the parts of the platform is to place a powdered or granular plastic material into the mold 104 or 106 when it is open. The mold 104 or 106 is then subjected to heat to melt the plastic while rotating the mold to fill the cavity with the melted plastic material. As the mold is cooled, the plastic solidifies the walls of the cavity to form the engagement structure and receiver along with any other shapes that must be formed therein.

Each portion may also be formed by blow-molding. Blow molding is particularly useful when forming large parts encompassing large volumes.

Figure 21:
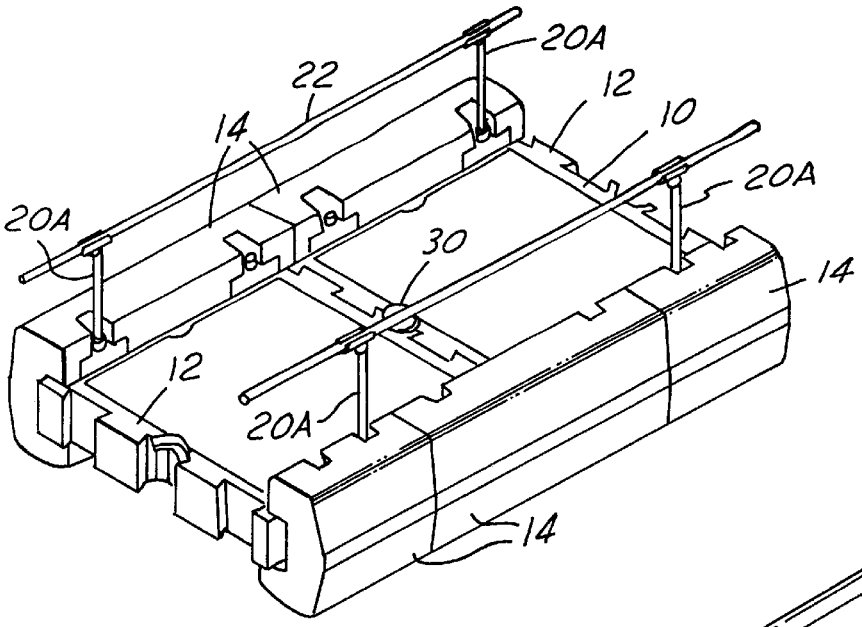
FIG. 21 is a perspective view of an alternate configuration using a pair of modular floats.

Referring now to FIG. 21, alternative configuration of a platform 10 is shown. The platform 10 is formed of two floats 12 and pontoons 14 along the elongated edge of platform 10. Railings 22 extend across the elongated edges of platform 10. Platform 10 may be used alone or as part of a walkway or floating bridge across wetlands.

Figure 22:
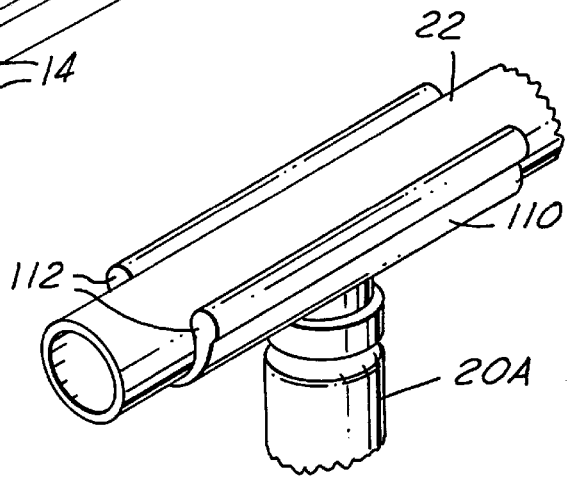
FIG. 22 is a perspective view of a fastener for connecting a rail or railing to a vertical railing support.

Referring now to FIG. 22, a perspective view of the connection for railing 22 is shown. A railing support 20A has a railing guide 110 fastened thereto. Railing guide 110 may be integrally formed with or connected later to railing support 20A. Railing guide 110 is shaped to hold the railing 22 securely therein. Railing guide 110 may have an expansion portion 112 which is used to form an interference fit with railing 22. Railing 22 may be snapped into railing guides 110.

It is preferred that all pieces of the platform are modular. In this manner, the basic units of the floats 12, pontoons 14, seat supports 16, railing supports 20A and railing 22 can be configured and reconfigured during the life of the product. It is further envisioned that the owner may wish to add on to meet additional needs of the owner.

Figure 23:
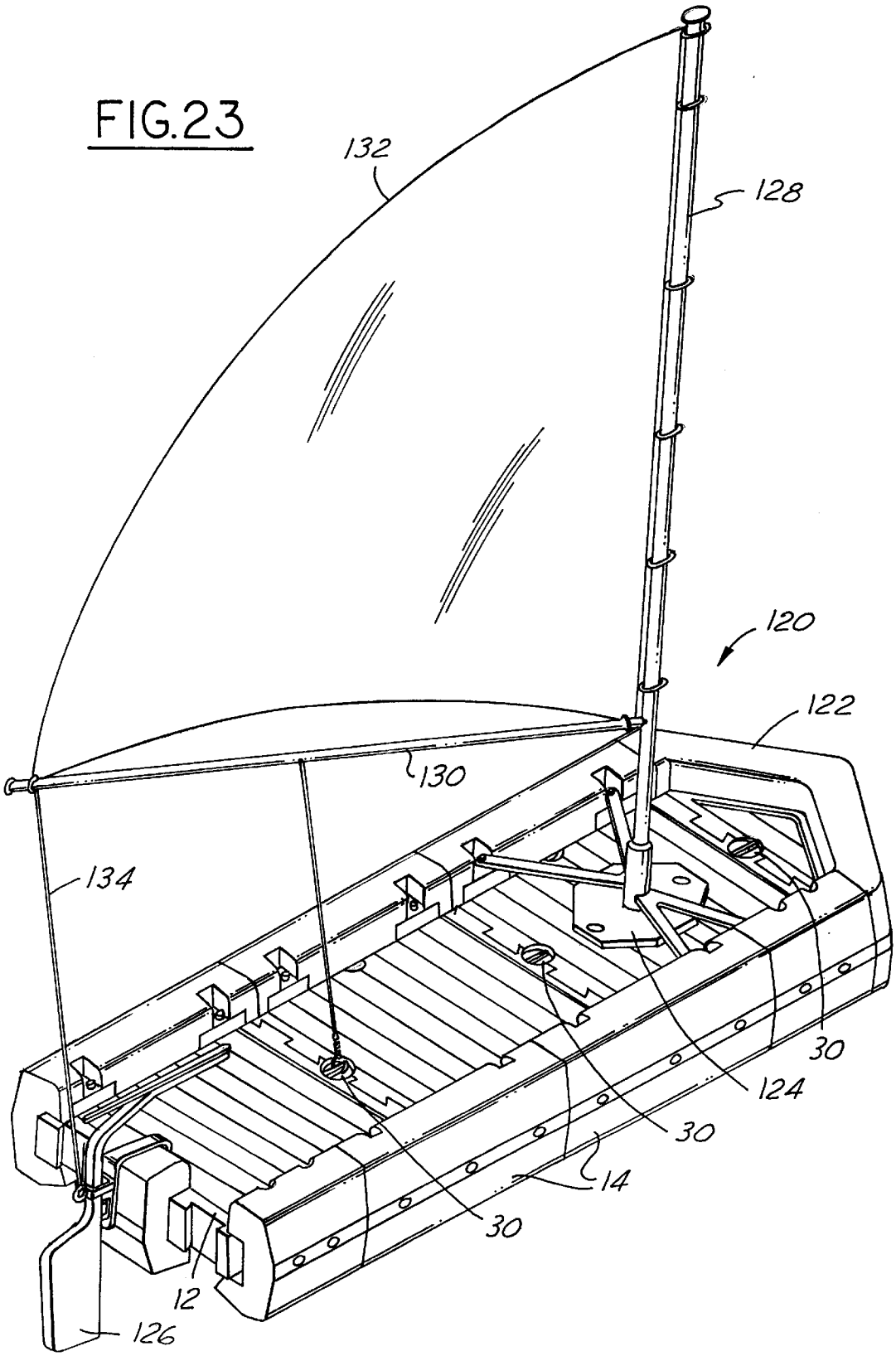
FIG. 23 is a perspective view of a modular float assembly configured as a sailboat.

Referring now to FIG. 23, a sailboat 120 is formed of many of the standard components as described above. For example, pontoons 14 are used on the edge of floats 12. Floats 12 are connected together using joining devices 30. In addition to some of the standard components, sailboat 120 has a bow portion 122 that is coupled to the front of the modular floats 12. Also, a mast holder 124 is coupled to floats 12. On the back of the boat a rudder 126 is coupled to float 12 to steer sailboat 120.

Bow portion 122 is preferably formed in a similar manner to that of pontoons 14. Bow portion 122 may be hollow and coupled to floats 12 by a joining device 30. Bow portion 122 is preferably pointed to allow sailboat 120 to move easily through the water.

A mast holder 124 provides a place for mounting a mast 128. Mast 128 supports a boom 130. Mast 128 and boom 130 support a sail 132. Guide rope 134 is coupled to boom 130 control the position of boom 130. Guide rope 134 may be coupled to a joining device 30 and to rudder 126.

Mast holder 124 has a mast receiver. Mast receiver 138 is preferably cylindrical and has a diameter able to receive mast 128 therein.

Figure 24:
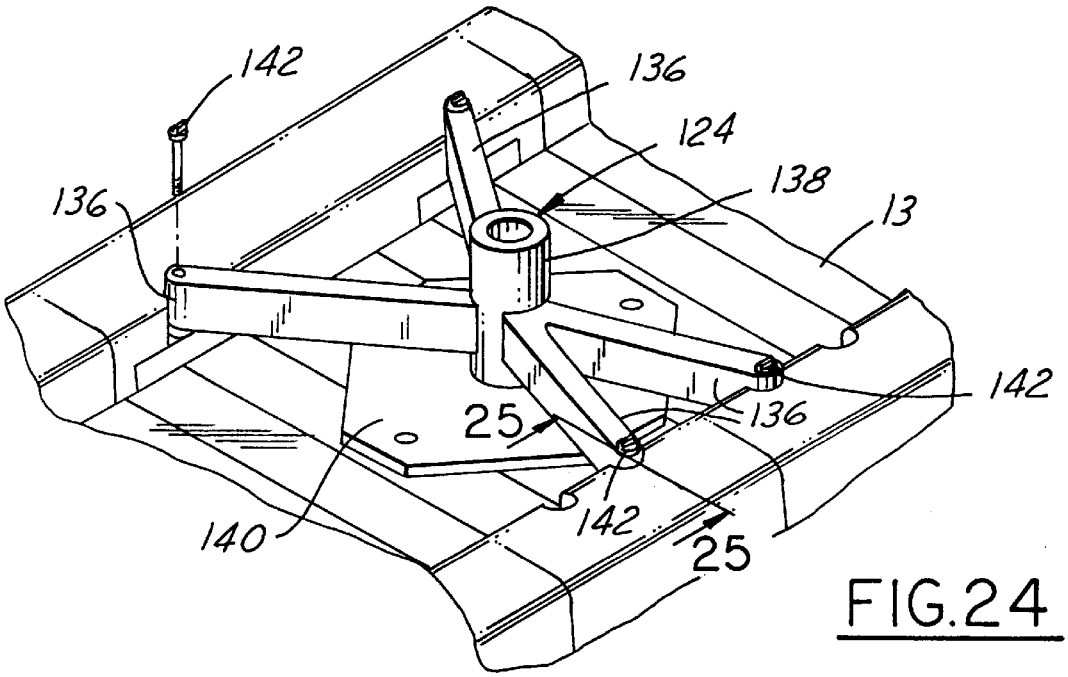
FIG. 24 is an enlarged perspective view of the mast mount of FIG. 23.

Referring now to FIG. 24, mast holder 124 has a number of arms 136 that extend from a mast receiver 138. Mast receiver 138 is preferably coupled to a base portion 140.

Base portion 140 rests along decking 13. Base portion 140 is used to distribute the load of the weight of the mast and sail along decking 13.

Figure 25:
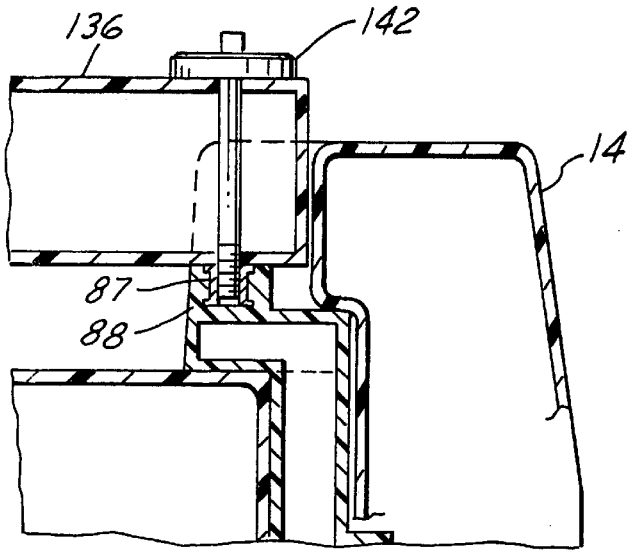
FIG. 25 is a cross-sectional view through where the mast mount couples to a pontoon.

Referring now to FIGS. 24 and 25, a fastener 142 is used to fasten each of the arms 136 to a pontoon attachment 88. Pontoon attachment 88 is the same as pontoon attachment 88 shown in more detail in FIG. 16. Fastener 142 extends through arm 136 and secures into blind insert 87 of pontoon attachment 88.

Figure 26:
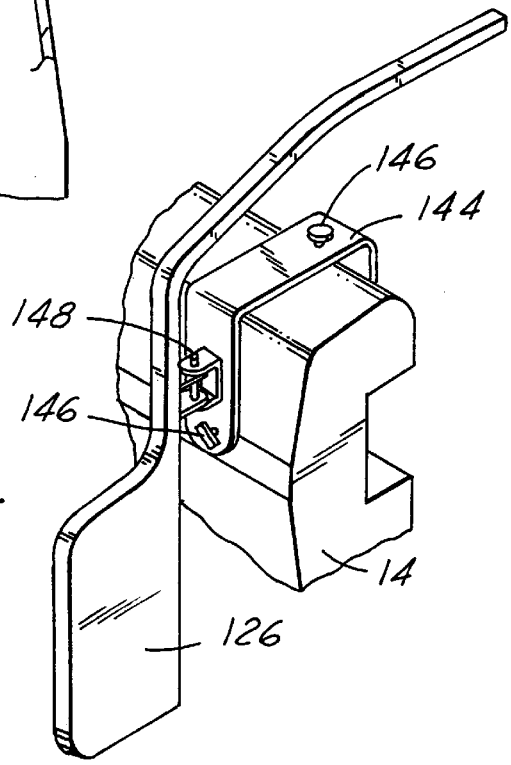
FIG. 26 is an enlarged perspective view of a rudder mounted to a pontoon.

Referring now to FIG. 26, rudder 126 is attached to pontoon 14 using a rudder bracket 144. Rudder bracket 144 is coupled to pontoon 14 by fasteners 146. Rudder 126 is coupled to rudder bracket 144 by a pin 148. Pin 148 allows the pivotal movement of rudder 126 with respect to bracket 144.

Figure 27:
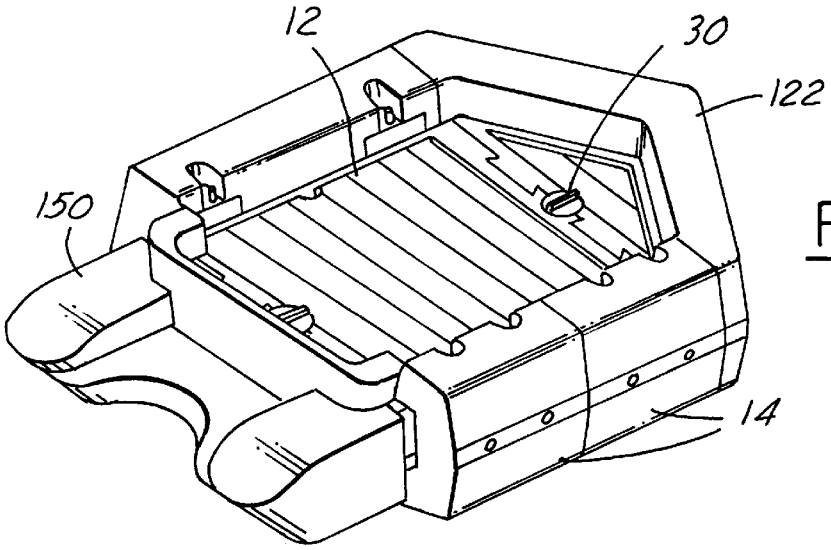
FIG. 27 is a perspective view of a modular float having a swim deck.

Referring now to FIG. 27, a float 12 is shown also using standard components described above such as pontoons 14, bow portion 122 and joining devices 30. The configuration of FIG. 27 has a swim platform 150.

While the best mode for carrying out the present invention has been described in detail, those familiar with the art to which this invention relates will recognize various alternative designs and embodiments for practicing the invention as defined by the following claims. For example, several methods may be evident to those skilled in the art for forming a float 12 and other associated components of a platform.

What is claimed is:

1. A modular float having a centerline and being of generally rectangular configuration comprising:

a top surface and a bottom surface through which the centerline extends; and four sides connecting said top surface and said bottom surface, each of said sides having a plurality of engagement structures extending therefrom, said engagement structures being spaced apart from each other and defining a plurality of receivers therebetween;

each receiver having a rear wall;

each engagement structure having a front surface;

each receiver having a pair of side walls which are spaced apart, with one side wall forming a side surface of one engagement structure and the other side wall forming a side surface of an adjacent engagement structure;

the side walls of each receiver converging towards one another as they extend from said rear wall in a direction away from said centerline;

said side walls of each receiver having the greatest distance therebetween adjacent said rear wall and a shorter distance therebetween at the front surfaces of adjacent engagement structures;

each of said sides having a channel extending between said top surface and said bottom surface, said channel being sized to receive a joining device.

2. A modular float as recited in claim 1, wherein said top surface, bottom surface and said sides define a hollow interior structure therebetween.

3. A modular float as recited in claim 1, further comprising an attachment device, said attachment device having an end sized to be received within one of said receivers.

4. A modular float as recited in claim 3, further comprising a pontoon, said attachment device receiving said pontoon to secure said pontoon with respect to said one receiver.

5. A modular float as recited in claim 4, wherein said attachment device having a first opening therethrough, said pontoon having a second opening therethrough corresponding with said first opening, a fastener extending through said second opening and into said first opening to secure said pontoon to said attachment device.

6. A modular float as recited in claim 3, wherein said attachment device further comprising a seat mount extending therefrom.

7. A modular float as recited in claim 6, wherein said seat mount is hollow.

8. A modular float as recited in claim 6, wherein said seat mount extending vertically and horizontally from said attachment device, said seat mount having a horizontal surface thereon.

9. A modular float comprising:

a top surface;

a bottom surface;

a plurality of sides connecting said top surface and said bottom surface, each of said sides having a plurality of engagement structures extending therefrom, said engagement structures being spaced apart from each other and defining receivers therebetween;

each of said sides having a channel extending between said top surface and said bottom surface, said channel sized to receive a joining device;

an attachment device having an end sized to be received within one of said receivers;

said attachment device further comprising a seat mount extending therefrom;

said seat mount extending vertically and horizontally from said attachment device, said seat mount having a horizontal surface thereon; and said horizontal surface having seat plugs extending therefrom.

10. A modular float as recited in claim 9, wherein said receivers are shaped to receive engagement structures from an adjacent modular float.

11. A modular float as recited in claim 9, wherein each of said engagement structures have edges which extend at an angle with respect to the side so that the width of each engagement structure increases as the distance from its corresponding side increases, the width of the receiver decreases as the distance from its corresponding side increases.

12. A modular float as recited in claim 9, wherein said top surface having a first recess therein, said bottom surface having a second recess therein opposite said first recess, said first recess and said second recess having a flange therebetween.

13. A modular float as recited in claim 12, further comprising a decking surface applied to said top surface.

14. A modular float as recited in claim 9, wherein said bottom surface having an elongated ridge formed therein.

15. A modular float as recited in claim 9, further comprising a seat having a seat socket formed therein, said seat socket sized to receive said seat plug.

16. A modular float comprising:

a top surface;

a bottom surface;

a plurality of sides connecting said top surface and said bottom surface, each of said sides having a plurality of engagement structures extending therefrom, said engagement structures being spaced apart from each other and defining receivers therebetween;

each of said sides having a channel extending between said top surface and said bottom surface, said channel sized to receive a joining device;

an attachment device having an end sized to be received within one of said receivers;

said attachment device further comprising a seat mount extending therefrom; and said seat mount having vertical grooves formed therein, said vertical grooves receiving vertical walls, said vertical walls and said seat mount defining a compartment.

17. A modular float as recited in claim 16, wherein said attachment device further comprising a railing receiver.

18. A modular float as recited in claim 17, wherein said railing receiver comprises a railing guide.

19. A modular float as recited in claim 18, further comprising a tubular railing received by said railing guide.

20. A modular float as recited in claim 16, further comprising a canopy, said canopy coupled to a tubular railing.

21. A floating structure comprising:

a plurality of identical modular interconnected floats;

each of said modular floats having a centerline and being of generally rectangular configuration, each float having a top surface and a bottom surface through which the centerline extends, and four sides connecting said top surface and said bottom surface;

each of said sides having plurality of engagement structures extending therefrom and a plurality of receivers;

said engagement structures being spaced apart;

said receivers being spaced apart, with one receiver located between a pair of adjacent engagement structures;

each receiver having a rear wall;

each engagement structure having a front surface;

each receiver having a pair of side walls which are spaced apart, with one side wall forming a side surface of one engagement structure and the other side wall forming a side surface of an adjacent engagement structure;

the side walls of each receiver converging towards one another as they extend from said rear wall in a direction away from said centerline;

said side walls of each receiver having the greater distance therebetween adjacent said rear wall and the shortest distance therebetween at the front surfaces of adjacent engagement structures;

the engagement structures at one side of one of said modular floats being vertically inserted into the receivers at one side of an adjacent modular float to form connections therebetween which are laterally inseparatable;

each of said sides of each float having a channel extending between said top surface and said bottom surface, said channel being sized to receive a joining device.

22. A floating structure as recited in claim 21, wherein each of said engagement structures have edges which extends at an angle with respect to the side so that the width of each of the engagement structures increases as the distance from its corresponding side increases, the width of each of the receivers decreases as the distance from its corresponding side increases.

23. A floating structure as recited in claim 21, further comprising an attachment device, said attachment device having an end sized to be received within one of said receivers.

24. A floating structure as recited in claim 23, further comprising a pontoon, said attachment device receiving said pontoon to secure said pontoon with respect to said one receiver.

25. A floating structure as recited in claim 24, wherein said attachment device having a first opening therethrough, said pontoon having a second opening therethrough corresponding with said first opening, a fastener extending through said second opening and into said first opening to secure said pontoon to said attachment device.

26. A floating structure as recited in claim 23, wherein said attachment device has a railing receiver.

27. A floating structure as recited in claim 23, wherein said attachment device further comprising a seat mount extending therefrom.

28. A floating structure as recited in claim 27, wherein said seat mount extending vertically and horizontally from said attachment device, said seat mount having a horizontal surface thereon.

29. A floating structure comprising:

a plurality of modular floats;

each of said modular floats having, a toll surface;

a bottom surface;

a plurality of sides connecting said top surface and said bottom surface, each of said sides having plurality of engagement means and a plurality of receiving means, said engagement means defining said receiving means, said engagement means for engaging a receiving means of an adjacent float, said receiving means for receiving an engagement means of an adjacent modular float;

a joining device for interlocking adjacent floats together;

a channel means in each of said sides extending substantially between said top surface and said bottom surface, said channel means sized to receive said joining device;

an attachment device having an end sized to be received within said receiving means;

said attachment device further comprising a seat mount extending therefrom;

said seat mount extending vertically and horizontally from said attachment device, said seat mount having a horizontal surface thereon; and said horizontal surface having seat plugs extending therefrom.

30. A floating structure as recited in claim 29, wherein said joining device is a twist lock device.

* * * * *